US005371519A

United States Patent [19]

Fisher

[11] Patent Number: 5,371,519

[45] Date of Patent: Dec. 6, 1994

[54] SPLIT SORT IMAGE PROCESSING APPARATUS AND METHOD

[75] Inventor: Paul A. Fisher, Scottsdale, Ariz.

[73] Assignee: Honeywell Inc., Minneapolis, Minn.

[21] Appl. No.: 25,690

[22] Filed: Mar. 3, 1993

[51] Int. Cl.[5] ..... G09G 1/02

[52] U.S. Cl. ..... 345/203; 345/200

[58] Field of Search ..... 345/200, 201, 202, 203, 345/189, 190, 191, 113; 395/164, 165, 166, 135

[56] References Cited

U.S. PATENT DOCUMENTS

| | | | |
|---|---|---|---|
| 4,047,248 | 9/1977 | Lyman et al. | 345/203 |
| 4,631,532 | 12/1986 | Grothe | 340/703 |
| 4,635,050 | 1/1987 | Grothe et al. | 340/734 |
| 4,679,038 | 7/1987 | Bantz et al. | 345/201 |
| 4,837,447 | 6/1989 | Pierce et al. | 395/164 |
| 5,113,516 | 5/1992 | Johnson | 395/500 |
| 5,175,809 | 12/1992 | Wobermin et al. | 395/141 |

*Primary Examiner*—Jeffery Brier
*Assistant Examiner*—A. Au
*Attorney, Agent, or Firm*—B. C. Downs; R. E. Champion; A. Medved

[57] ABSTRACT

An image processing apparatus processes image data representative of an image for a plurality of pixels of a display. The pixels have positions designated by locational addresses. The image data includes data elements and a first and second positional address for each data element corresponding to the locational addresses indicating to which pixel each data element corresponds. The image processing apparatus includes a device for sorting the data elements according to each of the first positional addresses. The device generates an output including the data elements and the second positional addresses of each data element in a first positional address order. An additional device sorts the output for the first positional addresses according to the second positional addresses. The additional device generates a display output of the data elements in a first positional address/second positional address order. A method for processing this image data includes sorting the data elements and second positional addresses of each data element according to the first positional addresses thereof. An output is generated including the data elements and their second positional addresses for each data element in a first positional order. The output is sorted according to the second positional addresses for each data element and a display output is generated of data elements in a first positional/second positional order.

25 Claims, 6 Drawing Sheets

20
IMAGE MEMORY CONTROL
PTR COPY
27
26
ROW ADDRESS
23
ROW SYNC
32
ADDRESS
30
POINTERS
END OF ROW POINTER 28
NEXT SEGMENT POINTERS 34
45
COLUMN ADDRESS
DATA ELEMENT
45
47
47
22
42
40
COLUMN ADDRESS
DATA ELEMENT
44 INITIAL SEGMENTS FOR ROWS
46 OVERFLOW SEGMENTS FOR ROWS
25
24
DATA ELEMENT
COLUMN ADDRESS

SPLIT SORT IMAGE PROCESSING APPARATUS AND METHOD

FIELD OF THE INVENTION

The present invention pertains to image data processing for a display system. In particular, the invention concerns split sort image processing using a split sort image memory for processing the image data of an image to be displayed.

BACKGROUND OF THE INVENTION

Conventional display systems utilize a graphics generator to generate image data information for display on display devices such as matrix devices, color mosaic devices, LCD devices or other raster scan display devices. The data generated by the graphics generator must be organized for use so that the image data can be scanned to permit the display of an image on a raster scanned display. One approach for sorting data elements representative of images such as pixel intensities or beam former impulses generated by the graphics generator, is the use of a full field image memory or in other words a bit-mapped technique.

With the use of a full field image memory, each picture element or pixel of an image is provided with a corresponding individual cell in the full field image memory. The image is produced by generating, for each pixel of the image, the color and intensity data or other data desired for each pixel and loading the appropriate data into the full field image memory. The image data is loaded into memory under graphics generator control and the entire full field image memory is read out in synchronism with the control circuitry generating a raster scan. The individual cells in the full field image memory may or may not correspond with the pixels of the physical display device as intervening processing between the image memory and the display device may allow the mapping to be other than one to one correspondence.

As indicated above, the full field image memory may be provided with a cell for every addressable location of the display. The x and y locations of the pixels of the display, the x address indicating the row and y address the column of a particular pixel, correspond to the addresses of the individual cells in the full field image memory and the image data elements for the pixels are stored in the individual cells as the data elements are generated by the graphics generator. A serial output for use in displaying the image represented by the data elements in the full field image memory is generated by scanning through all the addresses of the individual cells of the full field image memory in a desired x-y order. The serial output from the full field image memory is then converted to analog form and displayed.

From a hardware standpoint, this approach is unattractive because of the size of the required memory. For example, for displays of nominal size utilizing adequate color intensity levels and having adequate resolution, the memory capacities are large since every pixel has a corresponding individual memory cell. Further, for dynamic symbology, old data must be erased and new data for each pixel must be calculated and stored in the individual cells of the full-field memory repetitively. This results in a prohibitively high use of processor time and a resulting image whose update rate is unacceptably slow. For example, in a conventional system where only a small number of individual cells of the image memory are ever filled, such as a calligraphic or stroke written display, or one where polygons are represented by their outlines and filled in later by subsequent processing, there is a large waste of both image memory and processing time because all of the possible pixels have cell locations in the full field image memory and scanning the empty cell locations takes just as long as scanning full ones. It may be further appreciated that because of the necessity for rapid readout of the large full field memory, a high speed memory system often with special features such as serial ports would of necessity be utilized; such systems tend to be complex, expensive and critical in operation.

The depth of the full field image memory determines the maximum amount of image data that can be stored for any particular pixel of the display. In some image systems, such as a beamformer system as described in U.S. patent application Ser. No. 07/823,578 entitled, "Beamformer for Matrix Display", currently assigned to the assignee hereof, the data stored is in the form of impulses which are later expanded by the beamformer for display on a display device. Impulses as used herein includes not only visual data defining the image to be displayed, but also transitional data that defines the edges of shading and masking areas for the image to be displayed.

In some situations, for example, such as impulses as explained above where lines of an image intersect, it may be desirable to store more image data at a particular individual cell for a particular pixel of the display than is generally required over the majority of the individual cells. This results in an increase in size of memory for the entire image as all the individual cells of the full field image memory must be of sufficient depth to accommodate the largest amount of image data required for any individual cell anywhere in the image. An alternative to having all the individual cells being of sufficient depth to accommodate such data is to detect if an individual cell to be written is empty. If the cell is not empty, then the existing data is read and merged with the new data to be written. The merged data is then written into the cell. However, this results in an increase in processing time because to store data in a cell, the cell must be first read and the data merged prior to writing the data in the cell; thus utilizing two memory operations for all data storage instead of one operation.

Another disadvantage associated with the use of a full field image memory is related to masking. To mask data as it is written into the full field image memory, masking data must be generated and written into every location of an image plane so that a masking comparison can be done as data is generated by the graphics generator. If this must be done repetitively, i.e. moving masking, the processing time required for such generation and rewriting is prohibitive. The alternative is to make the full field image memory deep enough at each individual cell to store all of the image data that might be written for a particular pixel and mask the data during readout prior to display on a display device. However, this results in an even larger image memory than explained previously. The merging technique as explained above also does not work because it is not possible to unmerge image data which is later found to be masked.

Because of the disadvantages associated with the use of the full field image memory in sorting image data for display on a display device, a need is present for a new sorting apparatus which addresses these disadvantages.

In particular, there is a need for a system which addresses these disadvantages in conjunction with a display of images where only a small number of individual cells would have data in them.

SUMMARY OF THE INVENTION

According to the present invention which addresses the above mentioned disadvantages of full field image memories, there is provided an image processing apparatus for processing image data representative of an image for a plurality of pixels of a display. The pixels of the display have positions designated by locational addresses. The image data includes data elements and a first and second positional address for each data element corresponding to the locational addresses indicating to which pixel each data element corresponds. The apparatus includes first sorting means for sorting the data elements according to each of the first positional addresses. The first sorting means includes means for generating an output thereof including the data elements and the second positional address of each data element in a first positional address order. The apparatus also includes second sorting means which sorts the output for each of the first positional addresses according to the second positional addresses. The second sorting means includes means for generating a display output of the data elements in a first positional address/second positional address order.

In one embodiment of the invention, the first sorting means includes an image memory means for storing the data elements and the second positional address for each data element according to each of the first positional addresses. The image memory means includes first positional memory spaces, one for each first positional address, for storage of the data elements and the second positional addresses for each data element. First positional pointers determine locations to store the data elements and second positional address therefor in the first positional memory spaces and determines the data elements and second positional addresses therefor to be output in said first positional address order.

In another embodiment of the invention, the second sorting means includes second positional memory means for sorting the data elements from one of the first positional memory spaces of the image memory means. The second positional memory means includes second positional memory spaces for storing the data elements for each of the second positional addresses.

The present invention also includes a method for processing image data representative of an image for a plurality of pixels of a display. The pixels have positions designated by locational addresses. The image data includes data elements and a first and second positional address for each data element corresponding to the locational addresses indicating to which pixel each data element corresponds. The data elements and second positional address of each data element are sorted according to the first positional addresses thereof. An output is generated including the data elements and the second positional addresses of each data element in a first positional order. The output is sorted according to the second positional addresses for each data element and a display output is generated having data elements in first positional/second positional order.

In one embodiment of the method, the sorting of the data elements by the first positional addresses includes incrementing first positional pointers for first positional memory spaces of an image memory as designated by the first positional addresses of the data elements. The data elements and the second positional addresses are stored in the first positional memory spaces of the image memory.

In another embodiment of the method, the sorting of the output includes storing data elements of the output according to second positional addresses in second positional memory spaces of a second positional memory. Second data elements addressed to the same particular second positional address are stored in overflow memory spaces of the second positional memory spaces. Overflow pointers are set for the particular second positional addresses indicating that data elements are stored in the overflow memory spaces of the second positional memory.

DESCRIPTION OF THE PREFERRED EMBODIMENT

Figure 1:
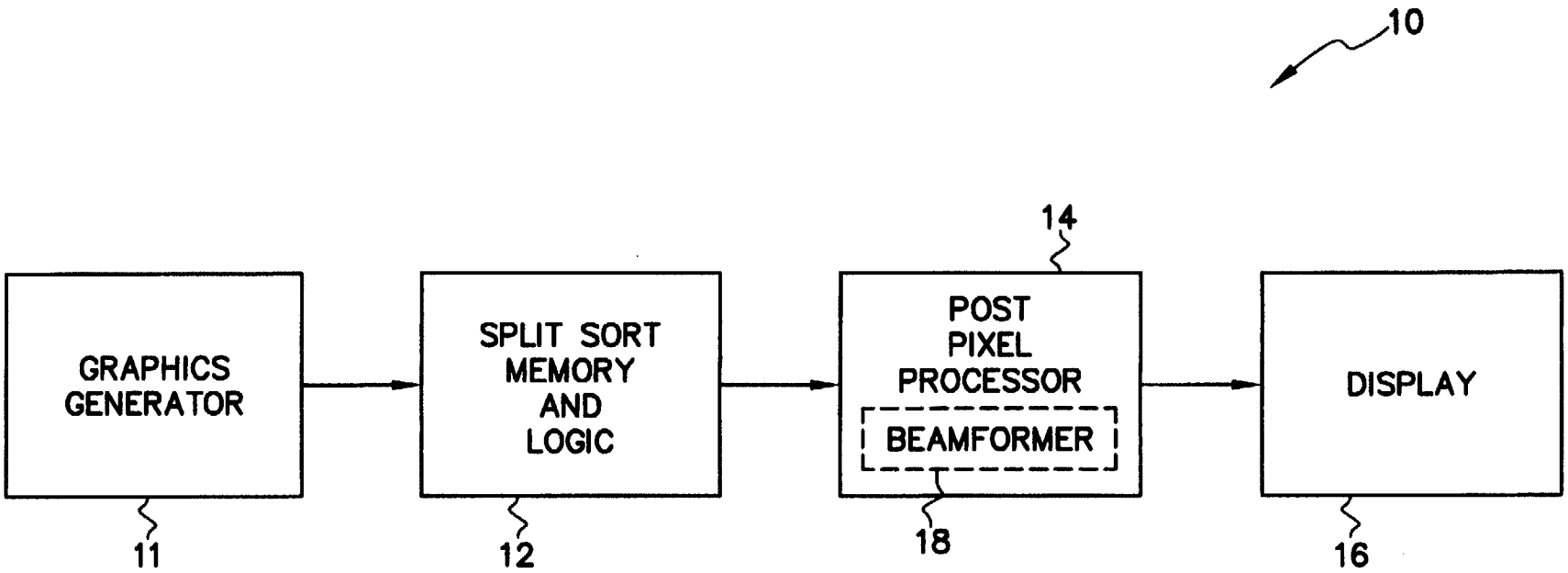
FIG. 1 is a high level block diagram of an image processing architecture for display of an image on a display device in accordance with the present invention.

In general terms, the split sort image processing apparatus of the present invention shall be described with reference to FIG. 1-3. An image display system 10, incorporating split sort image processing in accordance with the present invention, includes a graphics generator 11 for generating image data for an image, such as image 201, FIG. 2. The graphics generator 11 provides data elements defining image 201 and positional data, row and column addresses, for each data element corresponding to locational addresses, row and column addresses of the picture elements or pixels of a display face 200 of a display 16, indicating to which pixel the data element corresponds.

Figure 3:
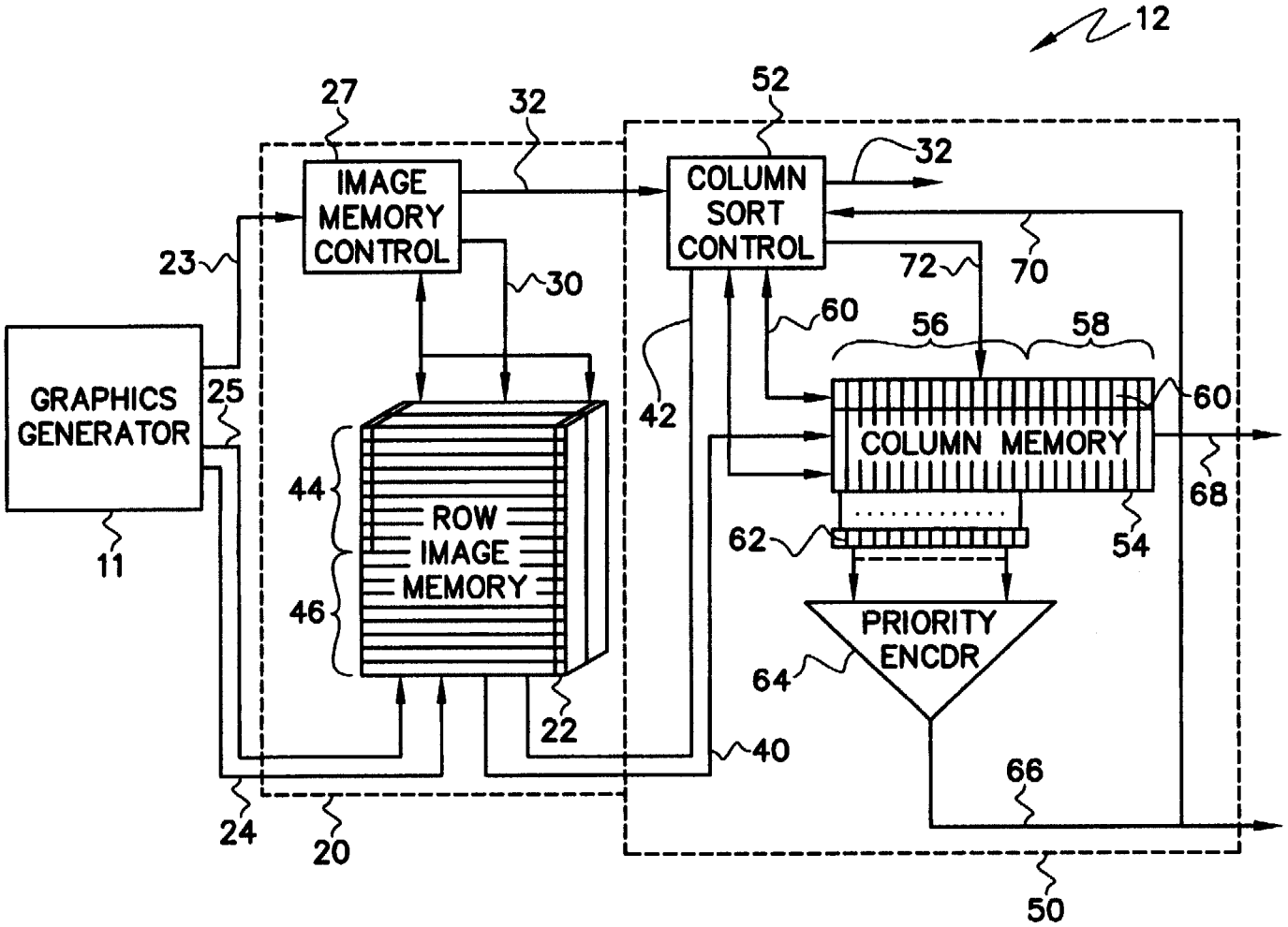
FIG. 3 is a block diagram of a portion of the image processing architecture shown in FIG. 1.
Figure 4:
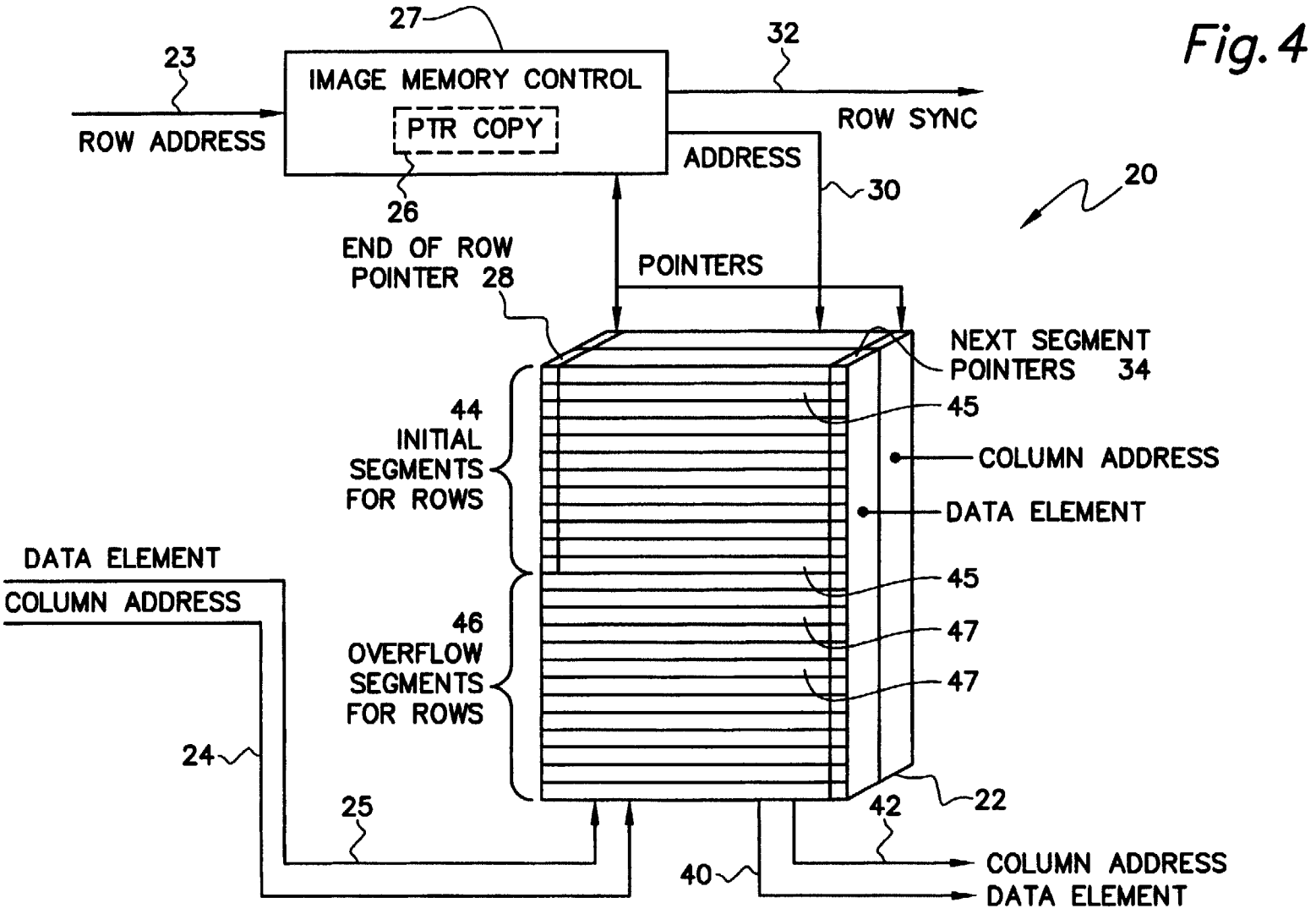
FIG. 4 is a block diagram of the row sort logic of FIG. 3.
Figure 5:
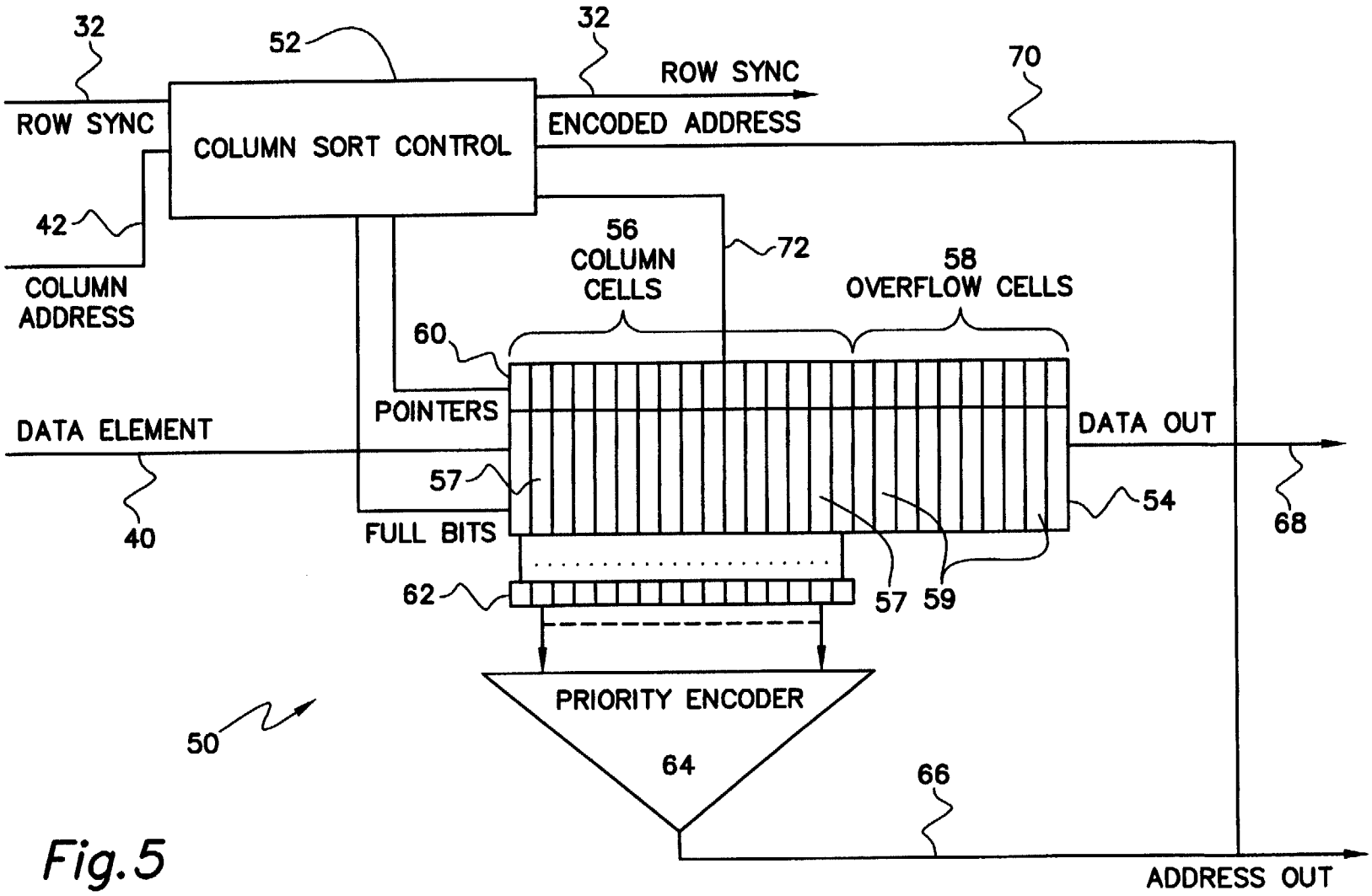
FIG. 5 is a block diagram of the column sort logic of FIG. 3.

The positional data, row and column addresses, and the data elements are sorted into lists according to row address by row image memory logic 20, FIG. 3. Such sorting is accomplished by storing image data elements and column addresses for such data elements for the image 201 in a row of memory including one or more segments of row image memory 22 associated with a particular row address. Within a row of segments of memory 22, however, the data elements and column addresses for the data elements are unsorted, or in other words are stored in cells of the segments in order of generation of the data elements. For example, a first generated data element having a row/column address (2,4) and a second generated data element having a row/column address (2,1) would be stored in memory space for row address (2) and the data element (2,4) would be stored prior to data element (2,1) as the column addresses remain unsorted.

After the entire image 201, including all the data elements and positional data, is generated by graphics generator 11, each row of data elements and column addresses for the data elements is read out of the rows of row image memory 22, one row at a time, to be sorted by column sort logic 50. The data elements are sorted into column order using the column addresses for such data elements and are stored in column memory 54 having cells for each possible column address. The column memory 54 is then read out in column order from column cells which have data therein to generate a display output. The display output is further processed by post pixel processing device 14 for display on display 16. The display output includes the data elements in a desired row/column order which is required to scan them into a raster scanned display.

The row image memory 22 stores only non-zero data so the amount of memory required is reduced as opposed to a full field memory. Processing time spent in this system is used to only process cells which contain data, not empty cells. This eliminates the need for special memories with high speed ports. In addition, because there is low cost in this system for adding more data elements for storage in the row image memory 22, more efficient schemes for generating masking and shading can be utilized. This system is particularly advantageous where only a small number of pixels have data associated therewith, such as a vector written system or a system where areas are represented by their edges.

Referring to FIGS. 1–5, the split sort image processing apparatus of the present invention shall be described in further detail. The image display system 10 is shown in block diagram form in FIG. 1. The image display system includes graphics generator 11, split sort image memory and logic 12, post pixel processing device 14, and a display 16. Display 16, such as a liquid crystal display, includes along X and Y coordinates thereof, rows and columns of picture elements or pixels. In operation, the display 16 is sequentially scanned along a row or a raster line having, in the preferred embodiment, 576 picture elements or pixels along each raster line. The display 16, in the preferred embodiment, includes 576 scan lines or rows of 576 pixels. Each pixel is at a location having an X, Y coordinate and which is defined by a row and column address of the location. One of ordinary skill in the art should readily recognize that the number of pixels per scan line and the number of scan lines may be varied to change resolution of the display and that the present invention is not limited to those numbers listed.

Figure 2:
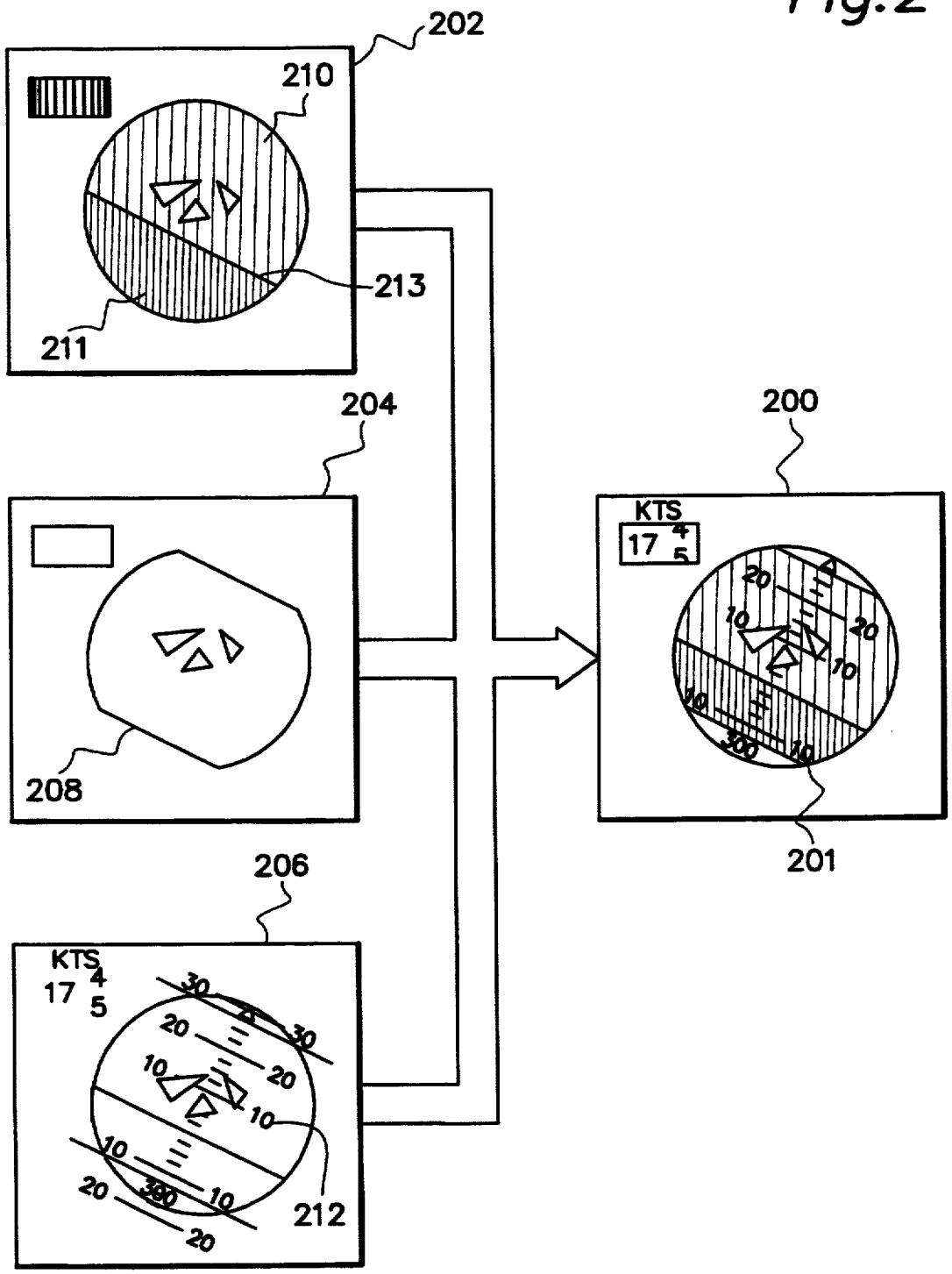
FIG. 2 is a diagram of an image on a display and image elements thereof.

A resulting image 201, FIG. 2, on the face 200 of the display 16 is achieved by means of the image display system 10. The display face 200 is for displaying multicolor symbology, for example, on an aircraft display. Images 202, 204 and 206 include representations of data elements which are generated to, when combined, form image 201. For example, line 213 of image 202 represents the intersection of a sky-ground transition. The shading 211 represents the ground and the shading 210 represents the sky. On the display face 200, these two zones would be of separate color to denote the sky and earth interface. Further examples of image representations include transition lines such as line 208 of image 204 for masking purposes or constant data such as numerals 212 of image 206. As is noted, various types of image information with regard to the images 202, 204 and 206 are processed to result in image 201.

The display face 200 of display 16 may be, for example, the face of a liquid crystal display but it is appreciated that the invention is applicable to other types of displays as well, such as gas plasma displays, conventional CRT displays or other electrically actuated displays. For clarity of description, a conventional raster display having a display face comprised of raster lines made up of individual pixels shall be used in the remainder description of the preferred embodiment. Such description shall be made in terms of a simple, non-interlaced raster. It should be understood that these raster lines may be generated sequentially, with each raster line containing sequentially generated pixels. However, it is not necessary that they be generated sequentially. The principles of the present invention are also applicable to a system having a conventional interlaced raster scan display with the odd raster lines in one frame and the even raster lines in the following frame. As previously discussed, the display face 200 shall consist of 576 raster lines which shall be referred to as rows in the remainder of the description. Each row contains 576 pixels aligned in columns along the rows with respect to each other. Further, while the present invention is described in terms of a rectangular coordinate (X,Y) raster scan display, it will be appreciated that the principles of the invention could also be applied to displays having other scanning systems. For example, addresses may be specified by polar coordinates for a radial scan system.

Data elements representing image 201 of display face 200 are generated by a conventional graphics generator 11. The graphics generator 11 generates pixel data or impulses from vectors, arcs, etc. Such conventional graphics generators may include stroke vector generators, symbol character generators, a generator as described in U.S. Pat. No. 4,631,532 to Grothe or U.S. Pat. No. 4,635,050 to Grothe, or any other graphics generator which is used to address locations on a display. The data is generated with a row and column address corresponding to a row and column position of a pixel of the display face 200. For example, the pixel in the upper left hand corner of display face 200 would have an address of (Row 0, Column 0) and the pixel at the lower right hand corner of display face 200 would have an address of (575, 575).

The data generated for the pixel locations by the graphics generator 11 may include color information, priority information, such as information designating whether one color should be displayed as opposed to another color when they overlap, sub-pixel positioning information, etc. Sub-pixel positioning data is utilized by a beamformer 18 of the post pixel processing device 14 to more finely position light energy as the display 16 is scanned. The use of a beamformer in conjunction with sub-pixel positioning data is further described in U.S. patent application Ser. No. 07/823,578 entitled, "Beamformer for Matrix Display," and herein entirely incorporated by reference thereto.

Other data may be generated by the graphics generator 11, and may include, for example, data with regard to masking plane 204, such as transition line 208. Image data elements which include transition locations associated with such transition lines as transition line 208 would be utilized to toggle between an allowed display state and an unallowed display state across the raster line of pixels. As such, certain data would only be displayed within the transition line 208. Further image data elements could include color shading transitions, such transitions to select for an on and off color zone such as color zones 211 and 210 of image 202. The transition line 213 through the two color zones would be utilized to transition between the two colors.

Such data elements as described above, when presented in row/column order to post-pixel processing device 14 may be utilized by logic schemes to implement color blending or priority, masking or shading for display applications. After post pixel processing, in raster scanned display devices the data is scanned across the display face in an orderly fashion, most often from left to right, top to bottom or across the row from left to right and down the rows. The frames of images presented on the display devices need to be refreshed at regular intervals. In image display systems, image refresh is accomplished by using an image memory. In the past such image memories were, conventional full-field image memories as discussed in the Background of the Invention section herein.

Full-field image memories provided for one storage location for every possible location or pixel on the display. Thus, the full field image memory could be visualized as a two dimensional array of storage locations addressed by an X-row address and a Y-column address. These addresses were then generated in synchrony with the display scanning motion to raster scan the display face. The full field image memory was read out to the display a row at a time. The depth of the full field image memory at any one location determined the maximum amount of data that could be stored for any one pixel of the display. In the prior system, each storage location was read whether or not it contained data and was used to activate the display. In addition, the full-field memory had to be cleared before the next image could be written. This could be done as data was scanned to the display, or as a separate step.

The present invention does not include a full field image memory. Rather data elements are processed and a display output is generated by split sort image memory and logic 12 for utilization by post-pixel processing device 14 for display of an image represented by the data elements. Split sort image memory and logic 12 includes row sort logic 20, FIG. 4, and column sort logic 50, FIG. 5. The row sort logic 20, includes a row image memory 22 for storing data elements and positional data generated by graphics generator 11 according to row addresses of the data elements; thus sorting the data elements by row address. Column sort logic 50 includes column memory 54 for storing data stored in one row of row image memory 22 according to the column addresses of the data elements in that particular row; thus sorting the data element by column address.

In other words, the image memory and logic 12 works by splitting the sorting process into two components. First, data elements and positional data are generated by graphics generator 11. The data elements are sorted into lists according to row address of the data element by storing the data elements and column address for each data element in rows of row image memory 22. Within a row of row image memory 22, however, the data elements and column addresses are unsorted, i.e., stored in order of generation as previously discussed.

Second, after the data elements for one frame of an image, such as image 201, on display face 200, FIG. 2, has been entirely generated by graphics generator 11, each row of row image memory 22, one row at a time, is read out of the row image memory 22 in the row order required by the display system. For simplicity purposes, the invention is described with reference to a system which reads out the rows from top to bottom. As each of the data elements and column address for each data element of the row is read out of row image memory 22, it is sorted into column order by storing the data elements in a column memory 54 according to the column address of the data element. The column memory 54 is then read out in column order to form a display output which is processed by post pixel processing device 14 and utilized to display the image on display 16. The memories utilized are preferably high speed static RAMS for increasing processing speed, but which need not include serial ports or other special data handling features.

The first and second components of the split sort image memory and logic 12 shall be described in further detail. The first component involves row sort logic 20 which includes image memory control 27. Image memory control 27 is the logic that controls the input of data elements and positional data to row image memory 22 and the reading of the data elements and positional data from row image memory 22 to be sorted by column sort logic 50. The image memory control 27 receives row addresses on row address line 23 from graphics generator 11 and addresses row image memory 22 via row image memory address line 30. The image memory control 27 with the use of pointers, explained further below, determines where in row image memory 22 to store data elements and column address for each data element applied to row image memory 22 by data line 25 and applied to row image memory 22 via column address line 24, respectively. Each data element and column address for the data element are stored at the row address of the data element as one piece of data.

Row image memory 22 includes 576 segments 45 of initial memory space 44 for storing data elements and the column address for such data elements according to the row address of the data elements. Each initial segment 45, having thirty two (32) cells in the preferred embodiment, includes an associated end of row pointer 28 which is capable of pointing to a segment and cell within that segment and a next segment pointer 34 which is capable of pointing to a segment associated therewith. In addition to the segments 45 of initial memory space 44, in the preferred embodiment one initial segment 45 being associated with each row of row image memory 22, the row image memory 22 also includes overflow memory space 46 which includes numerous more segments 47 of cells. Each segment 47 of the overflow memory space 46 also has a next segment pointer 34 associated therewith.

The image memory control 27 also includes a working copy 26 of the end of row pointers 28. When a data element and positional data are generated by graphics generator 11, the end of row pointer of the working copy 26 for the row address of the data element that is to be written, is updated to its next location and issued as the address of the location of row image memory 22 where the data element and column address are to be written. The data element is then written along with its column address via lines 24, 25 to the appropriate segment of initial memory space 44 corresponding to the row address of the data element.

The initial memory space 44, including initial segments 45, which are short segments having 32 cells including the two pointers, are linked together with segments 47 of overflow memory space 46 to form linked lists for particular row addresses if there are more data elements and column addresses than will fit in the initial segment 45 of the initial memory space 44. For example, data elements and column addresses are stored in these lists for a row address in the order in which the data elements are generated by graphics generator 11. When a row or segment 45 of initial memory space 44 is full, a next segment pointer 34 provides the linkage to the appropriate or next available overflow segment 47 of overflow memory space 46. Space at the beginning of each initial segment is reserved for the end of row pointer 28 to a particular segment and cell at the current end of the row and for the next segment pointer 34 at the end of that segment. When the segment is full and another data element for the row address needs to be written to the row, the address of the next available overflow segment 47 is written to the next segment pointer 34 of the current row being written to and the data is written in the first location of the new overflow memory segment 47. As such, the end of the row pointer 28 is also updated to point to that next segment 47. Thus, additional data elements in excess of the initial segment 45 for a particular row address are stored in the overflow memory space 46.

Where the row addresses for a large quantity of data elements are the same for an image, the data elements are stored in overflow memory space 46 and linked by means of the next segment pointers 34 such that the segment sizes of the segments 45 can be kept short and at a minimum. The segment sizes are chosen to be a balance between pointer overhead and memory wasted to the unused area of the segments. For example, in the preferred embodiment there are 4096 segments; 576 segments being part of the initial memory space. Each segment includes 32 cells with 2 locations per segment utilized as pointers; thus 8192 locations are used as pointers. On the average, 15 locations per row of one or more segments, which includes initial segments and overflow segments utilized for particular row addresses, will be left empty; thus 8640 ($576\times15$) will be left empty. Therefore, about 16,000 of the approximately 131,000 locations will be used as overhead. Doubling or halving the segment size will double one of either the number of locations used for pointers or number of the locations left empty and halve the other, resulting in an increase in the total.

After the image is entirely generated and stored in row image memory 22, the working copy of the end of row pointers 28 is written to the row image memory 22 for use in reading the rows of data elements from memory which are then sorted by column address by column sort logic 50. As one skilled in the art may recognize, the end of row pointers 28 may also be kept and updated in the row image memory 22 at all times, saving the cost of memory for the working copy 26. However, if the end of the row pointers 28 are kept in row image memory 22 at all times, it would require three memory cycles to write to the row image memory 22 rather than one cycle since an end of the row pointer 28 for a row address must be read and rewritten each time data elements are written into row image memory 22. The working copy 26 of the end of the row pointers need not be written to row image memory 22, but can be used to read the rows of data elements from the row image memory 22 and the end of row pointer cells in the row image memory 22 can be used for additional data element storage. However, if the row image memory 22 is double buffered or is in a ping-pong configuration as explained further below, the working copy 26 is written to row image memory 22 in order to use the working copy 26 to fill a second row image memory, i.e. the second buffer.

After the image has been completely generated and stored in the row image memory 22, the row image memory 22 is read out in row order to be further sorted in column sort logic 50. The image memory control 27 addresses the row image memory 22 via address lines 30 to read the data elements and column addresses for the data elements to the column sort logic 50 over data and column address lines 40 and 42. The image memory control 27 reads a row by first reading the associated end of row pointer 28. The control 27 then sequentially addresses the data in the rest of the initial segment 45 and chains to the overflow segment 47 when it reaches the next segment pointer 34. During this process, the address is compared to the end of row pointer 28 read previously. When data is read from the location corresponding to the end of row pointer 28, the row is terminated by asserting the row sync line 32 and the image memory control 27 then proceeds to read the next row.

After the data is read out of the row image memory 22, the memory 22 is cleared prior to the commencement of operation on the next image. The memory 22 is cleared by setting the end of row pointers 28 or their working copy 26 to point to one increment less than the first data location in the associated initial segment. The data in the rest of the row memory 22 does not need to be erased, in contrast to a full field memory where every location has to be cleared.

In a conventional full-field image memory where only a small number of cells are ever filled, such as a stroke written display or one where polygons are represented by their outlines and filled in by subsequent processing, there is a large waste of both memory space and time as all of the possible pixel locations must have memory associated therewith and scanning the empty cells takes just as long as scanning full ones. Utilizing the row image memory 22, storage area is necessary only for the non-zero data elements and the associated column addresses. Image memory cell locations for full-field memories where data is never written are eliminated with the use of this split sort image memory and logic apparatus. In addition, with a conventional full-field image memory, each cell has a fixed amount of data associated with it or in other words, the depth of such cells are limited. In some situations, such as line intersections or where masking or shading bits would be beneficial, there may be a large quantity of data which needs to be stored for one particular pixel. The full-field image memory would need to be enlarged over the entire field to accommodate such data element storage. With the split sort image memory and logic apparatus, the large quantity of data elements for a particular pixel, as opposed to other pixels, can be stored in distinct locations in the same row of the row image memory, with the same column address. Thus, the distinct advantages of the split-sort processing apparatus include the storage only of non-zero data so that the amount or memory required is reduced and the ability to store multiple pieces of data for the same pixel location. This allows the memory depth to be only large enough to contain the largest individual piece of data and the associated column address and not necessarily of such depth to contain all the pieces which may be needed to describe a particular pixel location.

With one frame of the image stored in row image memory 22, the second component of the split sort memory and logic 12 involving column sort logic 50 shall be described. Each cell of the segments 45, 47 of the row image memory 22, including the data elements and the column addresses for the data elements, is read out of row image memory 22, one row at a time, as described above. The column split logic 50 sorts the data elements read from the initial segments and overflow segments of a row of row image memory 22. The sorting of the row image memory 22 is done on a row by row basis as the data elements are read from the row image memory 22. The rows of data elements may include both data elements from the initial memory space 44 and overflow memory space 46. When a first row is addressed by a first row address on row address line 30, a first data element is read from the first row and applied via data line 40 to column memory 54. The column address for the data element read from the first row and stored with the data element for a particular pixel is sent via column address line 42 to column sort control 52. The column sort control 52 controls the inputting of the data elements in the column memory 54 and controls the reading of the data elements out of column memory 54 for data output on line 68 and column output on line 66.

The sorting of each row of data elements read from row image memory 22 is accomplished in much the same way as the sorting of the data elements by row address, as explained previously with regard to row image memory 22. Column sort logic 50 includes, in addition to the column sort control 52 and column memory 54, a priority encoder 64. The column memory 54 includes column memory space 56, having in the preferred embodiment 576 column spaces 57, one for each column address. These column spaces are typically very short segments, and in the preferred embodiment are only one cell. In addition to the column spaces 57, the column memory 54 includes overflow space 58 having numerous overflow cells 59. Each column space 57 and overflow cell 59 include a pointer 60 for pointing to a next location in a list of data elements stored for a particular column address or a zero if it is the end of the list of data elements for the particular address. In addition, associated with each column space 57 is a flip-flop forming a field of flip-flops 62 for indicating whether the column spaces 57 have data written therein.

When a data element and a column address for the data element are to be input from a row of the row image memory 22, column sort control 52 addresses column memory 54 via column address line 72. The flip-flop of the field of flip-flops 62 for that column address is also interrogated. If the flip-flop indicates that the column space 57 is empty for that particular column address, then the data element and a pointer 60 of zero is written to the column address. If the flip-flop indicates that the column space is not empty, the pointers 60 are chained through to find the end of the list for that particular column address. The end of the list depends on how many data elements for that particular column address have already been written to the overflow cells 59. The data element and a pointer of zero is then stored at the next available overflow cell 59 and that cell is connected to the end of the chain via the pointer 60 at the location which used to be the end of the chain. In addition, when the data element is written to a column space 57, the flip-flop for that cell is set to indicate that data has been stored therein. In a similar manner, all of the rest of the data elements and the associated column addresses for a row of row image memory 22 are read and the data elements are written to the particular column addresses in column memory 54. One skilled in the art will recognize that an end of the column pointer could be incorporated into the column sort logic much like the end of row pointer for the row image memory.

The column spaces 57 in the preferred embodiment are kept very short to save memory space for column memory 54. As with the row image memory 22, if a particular pixel has a large amount of data elements associated therewith, such data elements can be stored in the overflow space 58 without the need for large initial column memory space 56. Therefore, a first data element for a particular column address having a large quantity of data elements associated therewith is written in the column memory space 56 and the remainder of the data elements having that particular column address for the particular row read from row image memory 22 is stored in the overflow space 58 and linked to the column memory space 56 by the pointers 60.

Although data may be read out of the column memory 54 by scanning through each column memory space with the linked overflow cells, this would result in approximately the same amount of time that it takes to scan all the rows out of a conventional full-field image memory. Plus, additional time would be needed to scan the lists that are longer than one data element. Thus, although memory space would be saved by use of split sort processing, processing time would increase. To reduce time as well as space, the field of flip-flops 62 are utilized.

The field of flip-flops 62 are connected to a priority encoder 64. For readout of the data elements on data line 68, the priority encoder provides the column address of the first flip-flop of the field of flip-flops 62 which is set, indicating that a data element is stored in the associated column space 57. Therefore, the location of the non-zero data can be determined without scanning through all the column spaces 57 of the column memory 54. The priority encoder 64 applies the column address for the column space having data therein to column sort control 52 via lines 66,70. The column sort control 52 via column address line 72 addresses such column space 54 such that only the non-zero data in the row of data elements sorted by column address are output on data output line 68. The data elements in the overflow cells 59 linked to that particular column address are also output on data output line 68 in accordance with the pointers 60 described above. After all the data elements for one column address are output, the flip-flop for the particular column address is reset and the encoder then points to the next set flip-flop in the row of column addresses. The process is repeated until all non-zero data elements in the row are output. The column address is also output on column output line 66 for processing by post pixel processing device 14 as shall be explained further below. Each of the rows of row image memory 22 are read and sorted by column sort logic 50 and output on data output line 68 in the above manner. When the rows have been read, a new frame of data elements is generated and stored in row image memory 22.

The split sort processing apparatus provides image memory that is proportional to the number of data elements to be stored and the time taken to process the frames of the images is likewise proportional to the number of data elements for the pixels of the display. Because data elements are stored as linked lists, there is no practical limit to the amount of data that can be stored for one particular pixel location. This, of course, assumes that the total amount of data elements is less than the memory size. The depth of the memory is set by the size of the largest data element plus the column address size rather than like a full-field image memory where the total of all the possible data elements for one pixel determines the depth of the memory.

Several variations exist for the row sort logic 20 and the column sort logic 50. The column memory 54 was described as storing a single data element per column space 57. One skilled in the art would recognize that such column spaces may be enlarged to store more than one data element per column space. In addition, the priority encoder 64 was described as one large encoder operating on one field of flip-flops 62. The cost of this field of flip-flops can be minimized by arranging the flip-flops in groups, such as words in a memory. A relatively small encoder can then be used to give the address of the next column space having data elements therein. Time would be required to access the next word in the memory, however, although this would add time to the read out of the data elements, the time is constant and small compared to the reading out of every pixel if the memory is reasonably wide.

In addition, the rows of the row image memory 22 into which the data elements for the image are first sorted does not need to be complete rows. If it would be beneficial to later processing, the image memory could be multiple rows or segments of rows or rectangular regions consisting of multiple segments of rows. The "column" sort would then sort the region by row and column or column and row as desired for the processing to follow.

The data output of the column sort logic 50 provided on data output line 68 and column output line 66 is a list of all the data elements of each column address, together with the column number, i.e., the column address, sorted in a raster scan order, and a row sync 32 which separates the data for each row. This data output is provided to post pixel processing device 14. The data output provided to the post pixel processing device 14 can be utilized in a number of ways depending upon the display 16 involved in the application for the display system. If it is desired to compress the data output from the column sort logic 50 for transmission to a remotely mounted display, the column address output on column output line 66 will provide a basis for a "run length" encoding of the black between the elements. If encoding is not desired, the data can be expanded to insert the black between the elements. Conventional logic can be utilized to provide these functions.

Since there is no large depth penalty to adding more data for particular pixel locations for storage in the row image memory 22, efficient schemes of post pixel processing can be utilized. For example, if two lines of an image such as image 201, FIG. 2, are intersecting lines, data elements for both lines will be present at the data output for a single particular pixel location. These data elements could be easily processed with conventional data logic to implement blending or priority schemes.

Masking and shading of areas may be provided by including data for the outlines of shading or masking areas. These data elements are processed by the post pixel processing device 14. Since the data is in sorted order, it is only necessary that a flip-flop be provided for each shading or masking plane to save the current state, on or off, of each plane. As a transition is processed, the correct flip-flop is turned on or off, with the state of flip-flops representing the state of the planes at the current place in a raster scan. Thus, such additional data elements can be used to mask data or to determine background shading. For example, data elements representing the transition line 208 of a masking plane for image 201 as shown in FIG. 2 could be used to implement masking. When the data is output with regard to the transition line 208, logic of the post pixel processing device 14 can be utilized to turn on or off particular mask flip-flops. The state of these flip-flops can be used to inhibit selected pixel or shading data. In addition, logic can be used to combine the states of masking or shading planes. Because the areas can be defined by the relatively small cost of a flip-flop, some logic, and the memory space for the transitions, a large number can be provided and logically combined in the post pixel processing device 14 to form complex shapes. Without this capability, the graphics generator 11 would be required to generate the outline of the combined shapes. If one or more of the shapes is moving, a considerable amount of processing would be required. Also, the post pixel processing device 14 can utilize a beamformer to provide for the functions as described in pending U.S. patent application Ser. No. 07/823,578 entitled, "Beamformer for a Matrix Display", previously incorporated herein by reference thereto.

Figure 6:
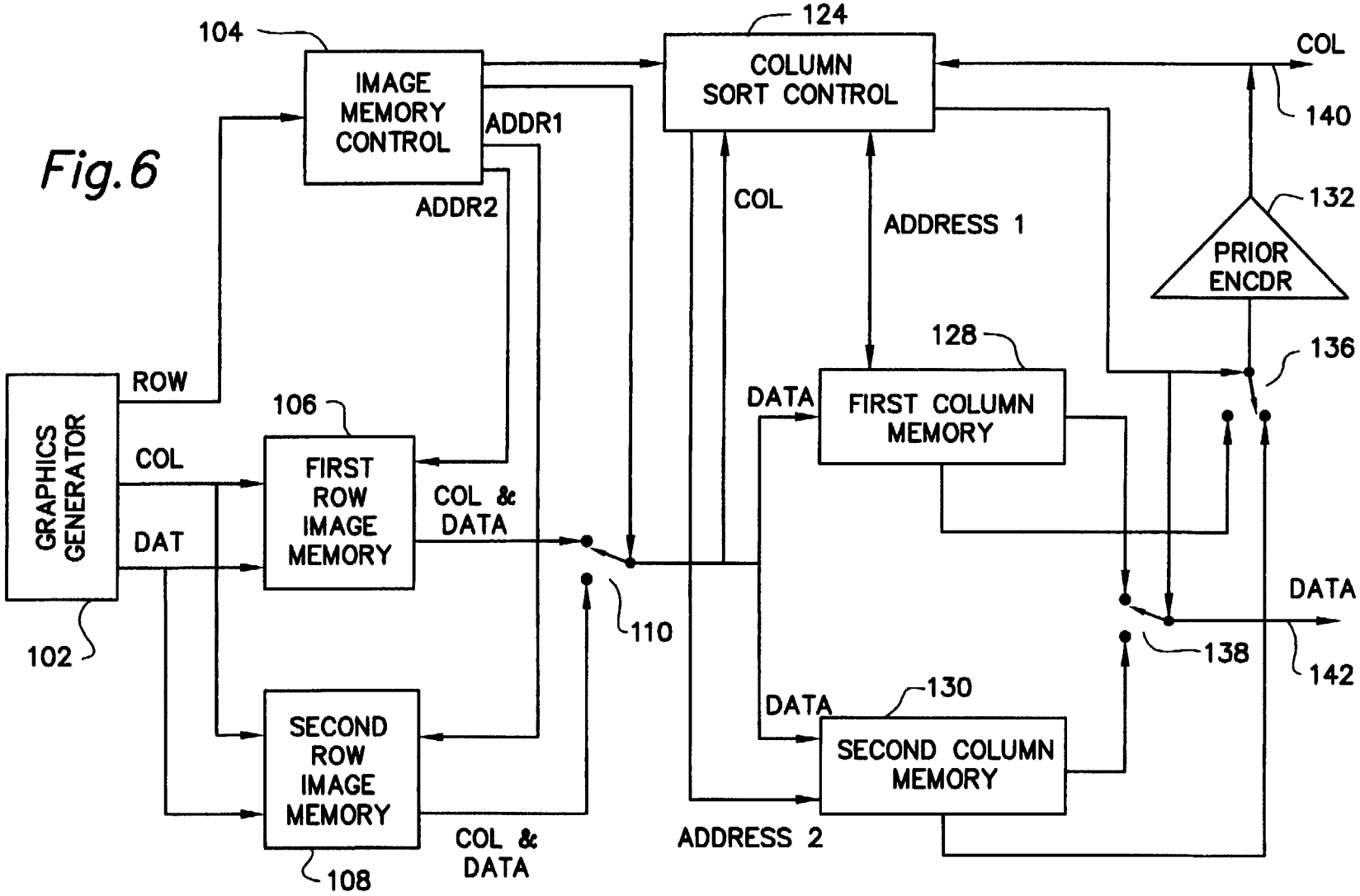
FIG. 6 shows an alternative embodiment of a ping pong image processing architecture configuration of the present invention.

As shown in FIG. 6, the row image memory 22 may be provided as ping-pong dual memories including a first row image memory 106 and a second row image memory 108. Likewise, the column memory 54 may be provided as ping-pong dual memories including a first column memory 128 and a second column memory 130. Under control of image memory control 104, the first row image memory 106 would be filled with a first image generated by graphics generator 102. As the first image is read out row by row from first row image memory 106 through multiplexer 110, a second image memory 108 is filled with a second image generated by graphics generator 102 under control of image control 104. With such dual memories, throughput can be increased. Just like the row image memories can be ping-ponged, the throughput of reading out data from rows of the first and second row image memory 106, 108 can be increased by the ping-pong column memories 128 and 130. As data is being written into first column memory 128, data can be read out of second column memory 130 which was previously written into. The column memories 128, 130 are read out of under control of multiplexer 136 and priority encoder 132 by way of column sort control 124 to provide a data output on line 142 and column output on line 140. As ping-ponging of memories is known in the art to provide for increased throughput, a further detailed description shall not be provided.

Those skilled in the art can recognize that only preferred embodiments of the present invention have been disclosed herein, other advantages may be found and realized, and various modifications may be suggested by those versed in the art, and it should be understood that the embodiments shown herein may be altered and modified without departing from the true spirit and scope of the invention as defined in the accompanying claims.

What is claimed is:

1. An image processing apparatus for processing image data representative of an image for a plurality of pixels of a display, the pixels having positions designated by locational addresses, the image data including data elements and a first and second positional address for each data element corresponding to the locational addresses indicating to which pixel each data element corresponds, said apparatus comprising:

first sorting means for sorting the data elements according to each of the first positional addresses, said first sorting means including:

image memory means for storing the data elements and the second positional address associated with each data element according to each of the first positional addresses said image memory means including initial segments for each first positional address for storage of the data elements and the second positional address associated with each data element, means for generating an output thereof, said output including the data elements, and the second positional address associated with each data element in a first positional address order; and second sorting means for sorting said output for each of the first positional addresses according to the second positional addresses, said second sorting means including means for generating a display output of the data elements sorted by the first positional address and the second positional address.

2. An apparatus according to claim 1, wherein said data elements include subpixel information, color information, intensity information and/or priority information.

3. An apparatus according to claim 1, wherein said first positional memory spaces include overflow first positional memory spaces for storage of data elements and second positional addresses of each data element in excess of a capacity of initial first positional memory space for a particular first positional address, said first positional pointer means generating a first positional linking pointer associated with said first positional memory space for designating locations in said overflow first positional memory spaces where a portion of the data elements and the second positional addresses for said portion of the data elements are stored.

4. An apparatus according to claim 1, wherein said second sorting means includes second positional memory means for sorting the data elements from one of said first positional memory spaces of said image memory means, said second positional memory means including second positional memory spaces for storing the data elements according to each of said second positional addresses.

5. An apparatus according to claim 4, wherein each of said second positional memory spaces for each of the second positional addresses include initial second positional memory space having storage capacity for a first data portion, said second positional memory spaces further including overflow second positional memory spaces for storage of a second data portion in excess of said storage capacity of said initial second positional memory spaces, further wherein said second positional memory means includes second positional linking pointer means for indicating a location if said second data portion is stored in said overflow second positional memory space.

6. An apparatus according to claim 5, wherein said first positional memory spaces include overflow first positional memory spaces for storage of data elements and second positional addresses of each data element in excess of a capacity of initial first positional memory space for a particular address, said first positional pointer means generating a first positional linking pointer associated with said first positional memory space for designating locations in said overflow first positional memory spaces where a portion of the data elements and the second positional addresses for said portion of the data elements are stored.

7. An apparatus according to claim 4, wherein said second sorting means includes priority encoding means for addressing in sequential order only the second positional memory spaces which have data elements stored therein.

8. An apparatus according to claim 7, wherein said priority encoding means includes flag means for indicating when data elements are stored in said second positional memory spaces.

9. An apparatus according to claim 6, wherein said second sorting means includes priority encoding means for addressing in sequential order only said second positional memory spaces having data elements stored therein, said priority encoding means including flag means for indicating when data elements are stored in said second positional memory spaces.

10. A method for processing image data representative of an image for a plurality of pixels of a display, the pixels having positions designated by locational addresses, the image data including data elements and a first and second positional address for each data element corresponding to the locational addresses indicating to which pixel the data corresponds, said method comprising the steps of:

sorting the data elements and second positional address of each data element according to the first positional addresses thereof;

generating an output including the data elements and second positional address for each data element in a first positional order;

sorting said output according to said second positional addresses for each data element;

generating a display output of data elements in a first positional/second positional order.

11. A method according to claim 10, wherein said step of sorting the data elements according to the first positional addresses include the steps of:

incrementing first positional pointers for first positional memory spaces of an image memory as designated by the first positional addresses of the data elements; and storing the data elements and the second positional addresses in said first positional memory spaces of said image memory.

12. A method according to claim 11, wherein said step of sorting the data elements according to the first positional addresses further includes the steps of:

storing further data elements in overflow first positional memory space when the first positional memory spaces are full of data elements; and storing a pointer to the overflow first positional memory space in the image memory.

13. A method according to claim 11, wherein said step of sorting said output according to said second positional addresses includes the step of storing the data elements in second positional memory spaces of a second positional memory according to each of said second positional addresses.

14. A method according to claim 13, wherein said step of sorting said output according to said second positional addresses includes the steps of:

storing first data elements of said output for particular second positional addresses in initial memory spaces of said second positional memory spaces;

storing second data elements addressed to the same particular second positional address in overflow memory spaces of said second positional memory spaces;

setting overflow pointers for the particular second positional addresses indicating that data elements are stored in said overflow memory spaces.

15. A method according to claim 14, wherein said display output generating step includes the step of addressing only the second positional memory spaces having data elements stored therein.

16. A method according to claim 15, wherein said step of storing the first and second data elements includes setting a full flag for said second positional memory spaces when data elements are stored therein and addressing only the second positional memory spaces having a full flag set therefor.

17. A method according to claim 13, wherein said display output generating step includes the step of addressing only the second positional memory spaces having data elements stored therein.

18. A method according to claim 17, wherein said step of storing the first and second data elements includes setting a full flag for said second positional memory spaces when data elements are stored therein and addressing only the second positional memory spaces having a full flag set therefor.

19. A method according to claim 14, wherein the step of sorting said output according to said second positional addresses includes the step of storing the data elements in second positional memory spaces of a second positional memory according to each of said second positional addresses.

20. A method according to claim 19, wherein the step of sorting said output according to said second positional addresses includes the steps of:

storing first data elements of said output for particular second positional addresses in initial memory spaces of said second positional memory spaces;

storing second data elements addressed to the same particular second positional address in overflow memory spaces of said second positional memory spaces;

setting overflow pointers for the particular second positional addresses indicating that data elements are stored in said overflow memory spaces.

21. An image processing apparatus for processing image data from a graphics generator comprising:

a) a row image memory in communication with said graphics generator capable of storing data elements and second positional address data, said row image memory having:

1. an initial memory space comprised of a plurality of initial segments, and,
2. an overflow memory space comprised of a plurality of overflow segments;

b) an image memory control in communication with said graphics generator and said row image memory for receiving first positional address data from said graphics generator and controlling storage of associated data elements and second positional address data into said initial memory space and said overflow memory space sorted according to said first positional address data;

c) a column memory in communication with said row image memory capable of storing data elements; and, d) a column sort control in communication with said row image memory and said column memory and controlling the storing of data elements from said row image memory into said column memory according to said second positional addresses data.

22. The image processing apparatus according to claim 21 wherein said data elements are communicated to said column memory sorted by said first positional address data.

23. The image processing apparatus according to claim 22 wherein each of said plurality of initial segments is designated to store said data elements and said second positional address data associated with a predetermined first positional address.

24. The image processing apparatus according to claim 23 wherein, said column memory is comprised of a plurality of column spaces for storing data elements, each of said plurality of column spaces designated to store data elements associated with a predetermined second positional address.

25. The image processing apparatus according to claim 24 further comprising at least one priority encoder in communication with said column memory and said column sort control, said priority encoder generating a signal indicative of a column space containing data.

* * * * *

UNITED STATES PATENT AND TRADEMARK OFFICE

CERTIFICATE OF CORRECTION

PATENT NO. : 5,371,519

DATED : December 6, 1994

INVENTOR(S) : Paul A. Fisher

It is certified that error appears in the above-indentified patent and that said Letters Patent is hereby corrected as shown below:

Column 17, line 35,

Claim 19, line 1, cancel "14" and substitute --10--.

Signed and Sealed this

Fourteenth Day of March, 1995

*Attest:*

*Attesting Officer*

BRUCE LEHMAN

*Commissioner of Patents and Trademarks*